US007958757B1

(12) United States Patent
Lee

(10) Patent No.: US 7,958,757 B1
(45) Date of Patent: Jun. 14, 2011

(54) CAM LOCK FOR A CABINET

(75) Inventor: Miko Lee, Hsinchuang (TW)

(73) Assignee: ABA UFO International Corp., Taipei Hsien (TW)

( * ) Notice: Subject to any disclaimer, the term of this patent is extended or adjusted under 35 U.S.C. 154(b) by 0 days.

(21) Appl. No.: 12/722,505

(22) Filed: Mar. 11, 2010

(51) Int. Cl.
*E05B 37/02* (2006.01)

(52) U.S. Cl. ..... 70/21; 70/213; 70/284; 70/285; 70/312; 70/491

(58) Field of Classification Search ..... 70/21, 213, 70/215, 284, 285, 312, 446, 491, 496, DIG. 23, 70/DIG. 44, DIG. 62, DIG. 71
See application file for complete search history.

(56) References Cited

U.S. PATENT DOCUMENTS 6,508,089 B1 * 1/2003 Tsai ..... 70/213
6,513,356 B1 * 2/2003 Yang ..... 70/213
7,367,207 B2 * 5/2008 Yang ..... 70/284
7,444,844 B1 * 11/2008 Lee ..... 70/21
7,628,047 B2 * 12/2009 Lee ..... 70/284
2006/0016232 A1 * 1/2006 Hung ..... 70/491
* cited by examiner

*Primary Examiner* — Lloyd A Gall
(74) *Attorney, Agent, or Firm* — Hershkovitz & Associates, LLC; Abraham Hershkovitz

(57) ABSTRACT

The main objective of the present invention is to provide a cam lock that allows the user to find the correct code when forgetting. The cam lock has an inner shell, an outer shell, a main core assembly, a secondary core assembly, a tongue and an identification assembly. A cover of the outer shell and the inner shell are secured to each other and are mounted rotatably with the rear casing of the outer shell. The main and secondary core assemblies are mounted in the inner shell. Either the main and secondary core assemblies is unlocked, the tongue is rotatable. The identification assembly cooperates with the secondary core assembly to find the code via unlocking the secondary core assembly. Therefore, the cam lock is convenient for use.

12 Claims, 13 Drawing Sheets

CAM LOCK FOR A CABINET

BACKGROUND OF THE INVENTION

1. Field of the Invention

The present invention relates to a cam lock, especially to a cam lock used for lock a cabinet and the like.

2. Description of the Prior Arts

Combination locks are widely used and are small to adapt for most cabinets, such as lockers and so on. Users rotate the wheels for inputting certain codes to lock or unlock the combination locks so that no keys are required. However, once the user forgets the code, the combination lock cannot be unlocked unless the combination lock is destroyed. For the lockers, most users only utilize the lockers temporarily. When the code is forgotten, not only the user may not take out the things inside the lockers but also the manager has to cost to destroy and to change the combination lock. Therefore, the combination lock is not easy for use.

To overcome the shortcomings, the present invention provides a cam lock to mitigate or obviate the aforementioned problems.

SUMMARY OF THE INVENTION

The main objective of the present invention is to provide a cam lock that allows the user to find the correct code when forgetting. The cam lock has an inner shell, an outer shell, a main core assembly, a secondary core assembly, a tongue and an identification assembly. A cover of the outer shell and the inner shell are secured to each other and are mounted rotatably with the rear casing of the outer shell. The main and secondary core assemblies are mounted in the inner shell. Either the main and secondary core assemblies is unlocked, the tongue is rotatable. The identification assembly cooperates with the secondary core assembly to find the code via unlocking the secondary core assembly. Therefore, the cam lock is convenient for use.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
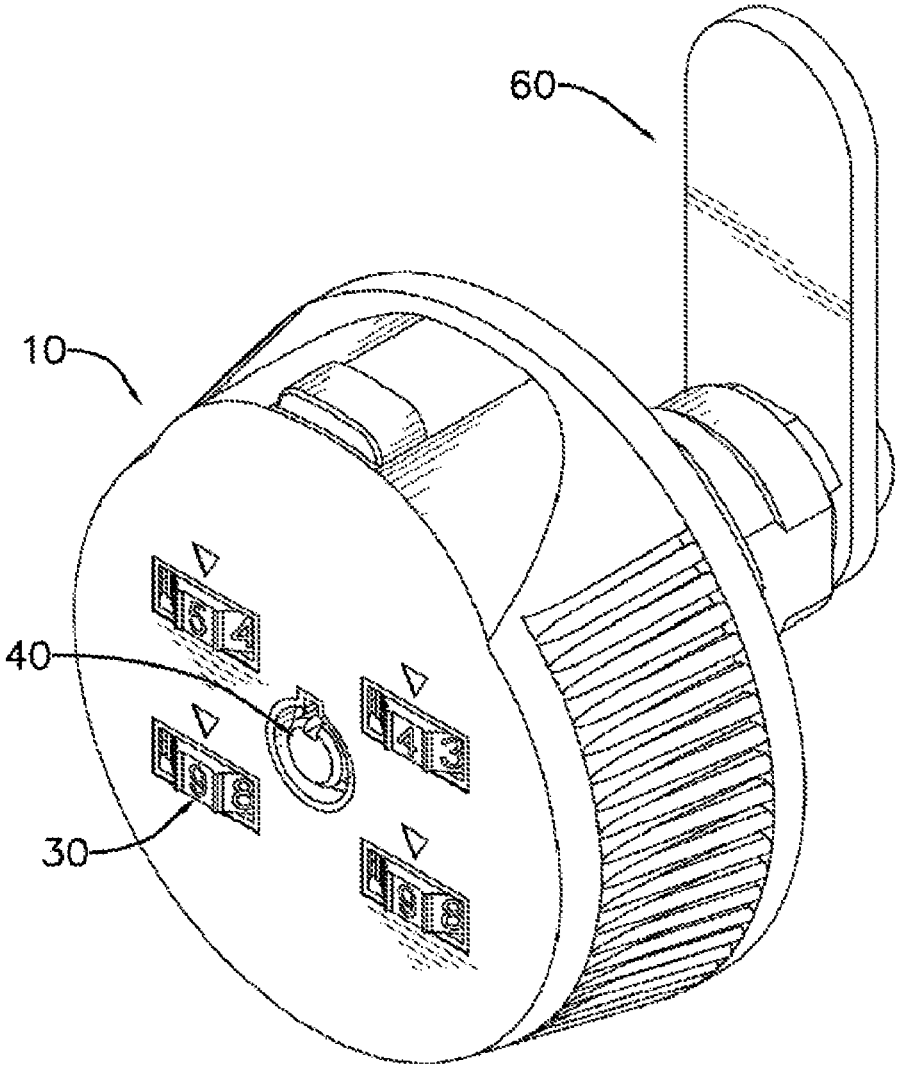
FIG. 1 is a perspective view of a cam lock for a cabinet in accordance with the present invention.
Figure 2:
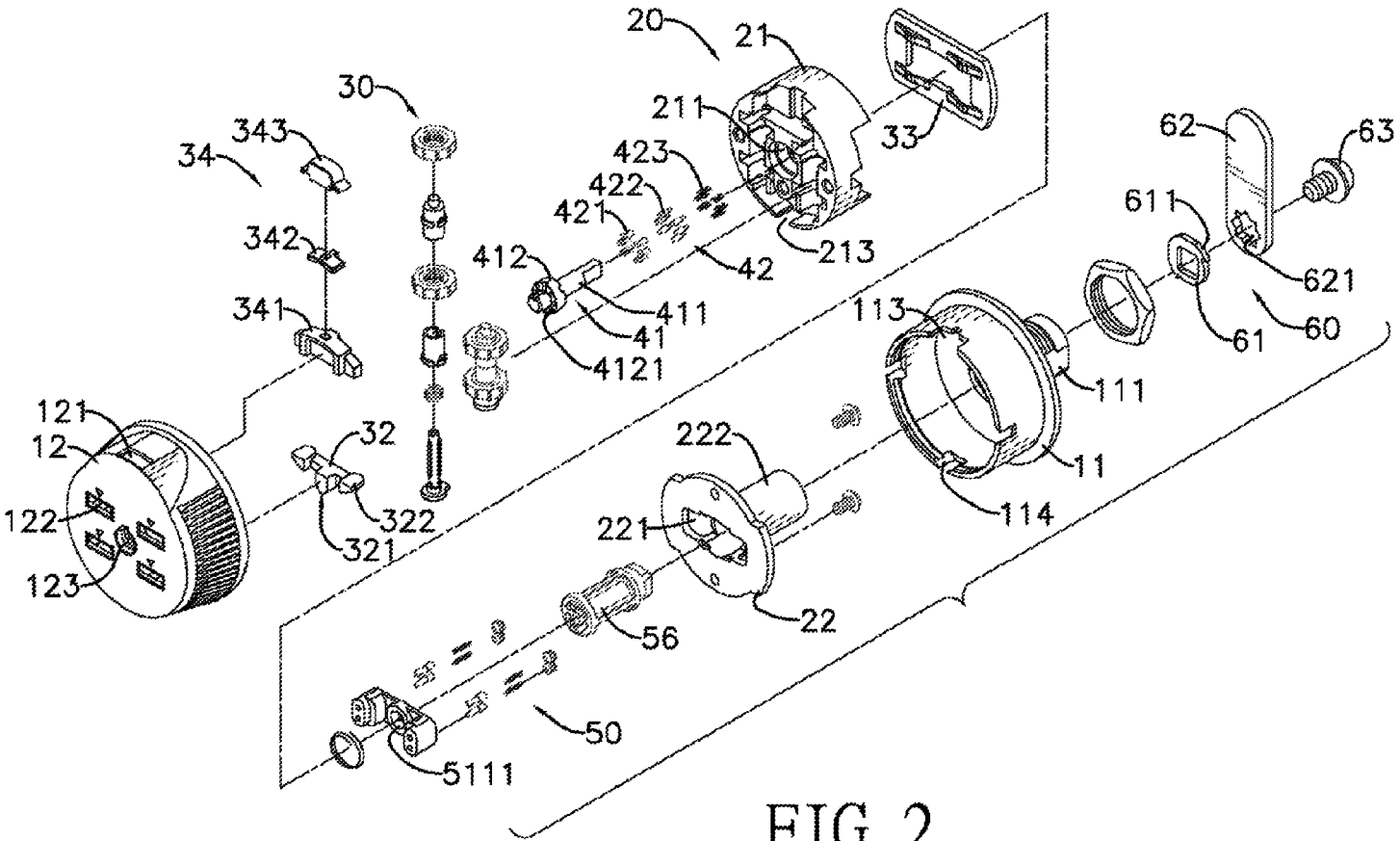
FIG. 2 is an exploded perspective view of the cam lock in FIG. 1.

With reference to FIGS. 1 and 2, a cam lock for a cabinet in accordance with the present invention comprises an outer shell (10), an inner shell (20), a main core assembly (30), a secondary core assembly (40), an identification assembly (50) and a tongue assembly (60).

Figure 3:
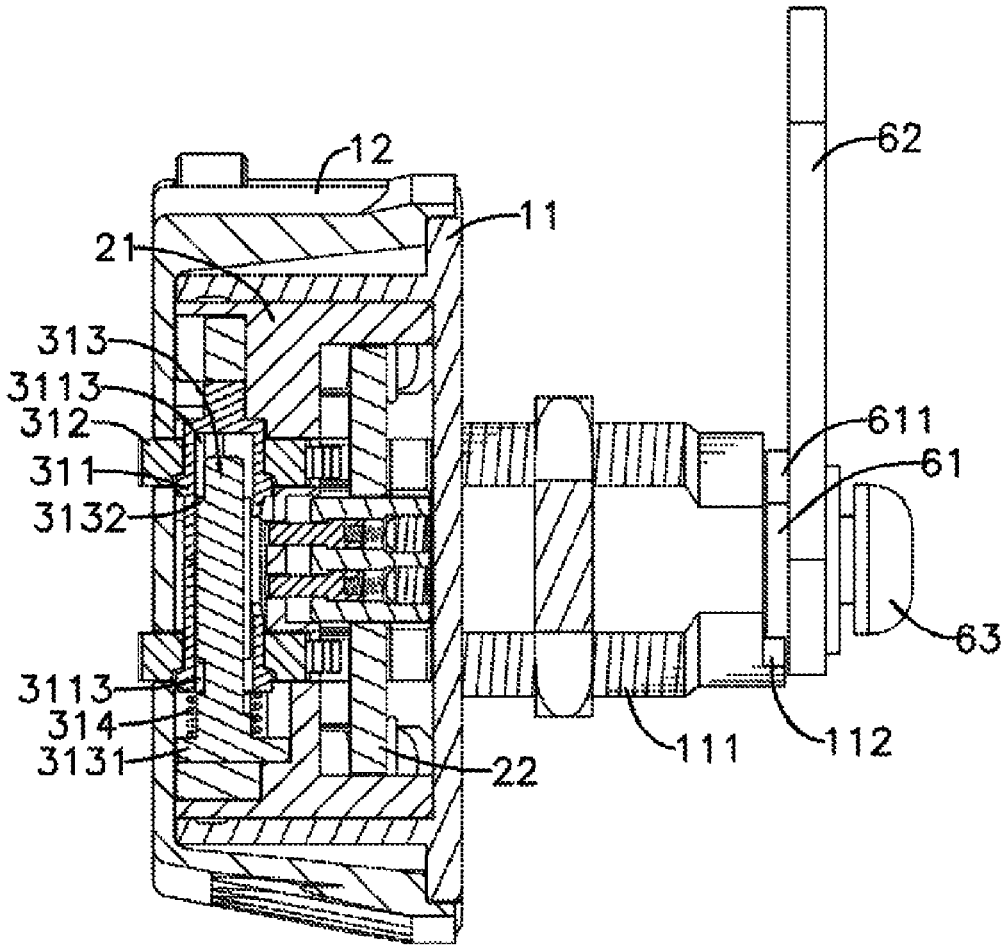
FIG. 3 is a side view in partial section of the cam lock in FIG. 1.

With reference to FIGS. 2 and 3, the outer shell (10) comprises a rear casing (11) and a cover (12). The rear casing (11) is hollow and has a front opening, a rear surface, a guiding sleeve (111), a stop (112), a yoke notch (113) and a mounting hole (114). The guiding sleeve (111) is formed longitudinally on the rear surface of the rear casing (11). The stop (112) is formed on a rear end of the guiding sleeve (111). The yoke notch (113) and the mounting hole (114) are formed through a sidewall of the rear casing (11) and may be opposite to each other by 180 degrees. The mounting hole (114) has two inclined sidewalls. The cover (12) is mounted rotatably around the rear casing (11), communicates with the front opening of the rear casing (11) and has a rear opening, a through hole (121), multiple dial holes (122) and a first keyhole (123). The through hole (121) is formed through a sidewall of the cover (12) and selectively aligns with the yoke notch (113) of the rear casing (11). The dial holes (122) and the first keyhole (123) are formed through a front surface of the cover (12).

Figure 9:
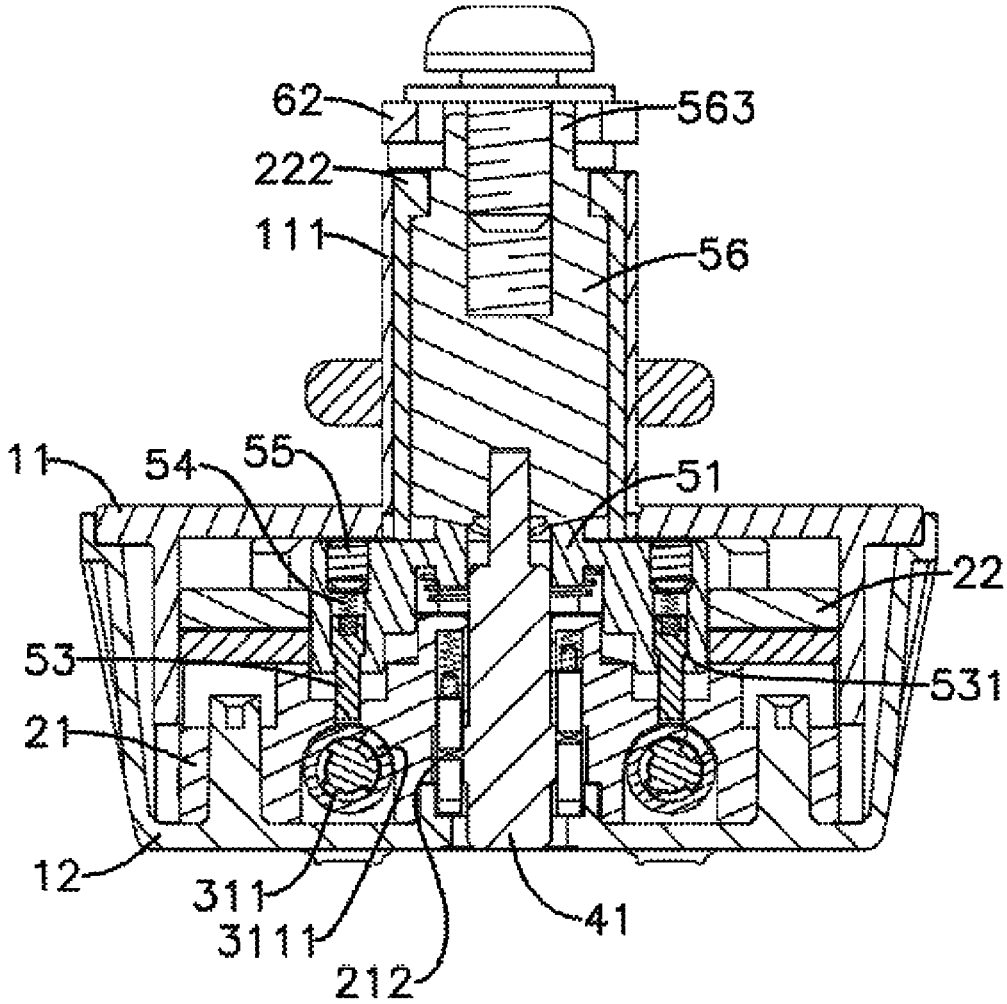
FIG. 9 is another cross-sectional top view of the cam lock in FIG. 1.

With reference to FIGS. 2 and 9, the inner shell (20) is mounted in the outer shell (10) and comprises a front casing (21) and a rear panel (22). The front casing (21) is attached securely to the cover (12) and has a second keyhole (211), multiple pin recesses (212) and a connecting hole (213). The second keyhole (211) is formed through the front casing (21) and aligns with the first keyhole (123) of the cover (12). The pin recesses (212) are formed in the front casing (21) and are arranged around the second keyhole (211) of the front casing (21). The connecting hole (213) is formed through a sidewall of the front casing (21) and selectively aligns with mounting hole (114) of the rear casing (11). The rear panel (22) is attached securely to a rear surface of the front casing (21) and has an elongated hole (221) and a connecting sleeve (222). The elongated hole (221) is formed through the rear panel (22). The connecting sleeve (222) is formed on a rear surface of the rear panel (22), communicates with the elongated hole (221), aligns with the second keyhole (211) and is mounted through and protrudes out of the guiding sleeve (111). Two gaps are formed respectively between an end of the connecting sleeve (222) and the rear surface of the rear panel (22).

Figure 4:
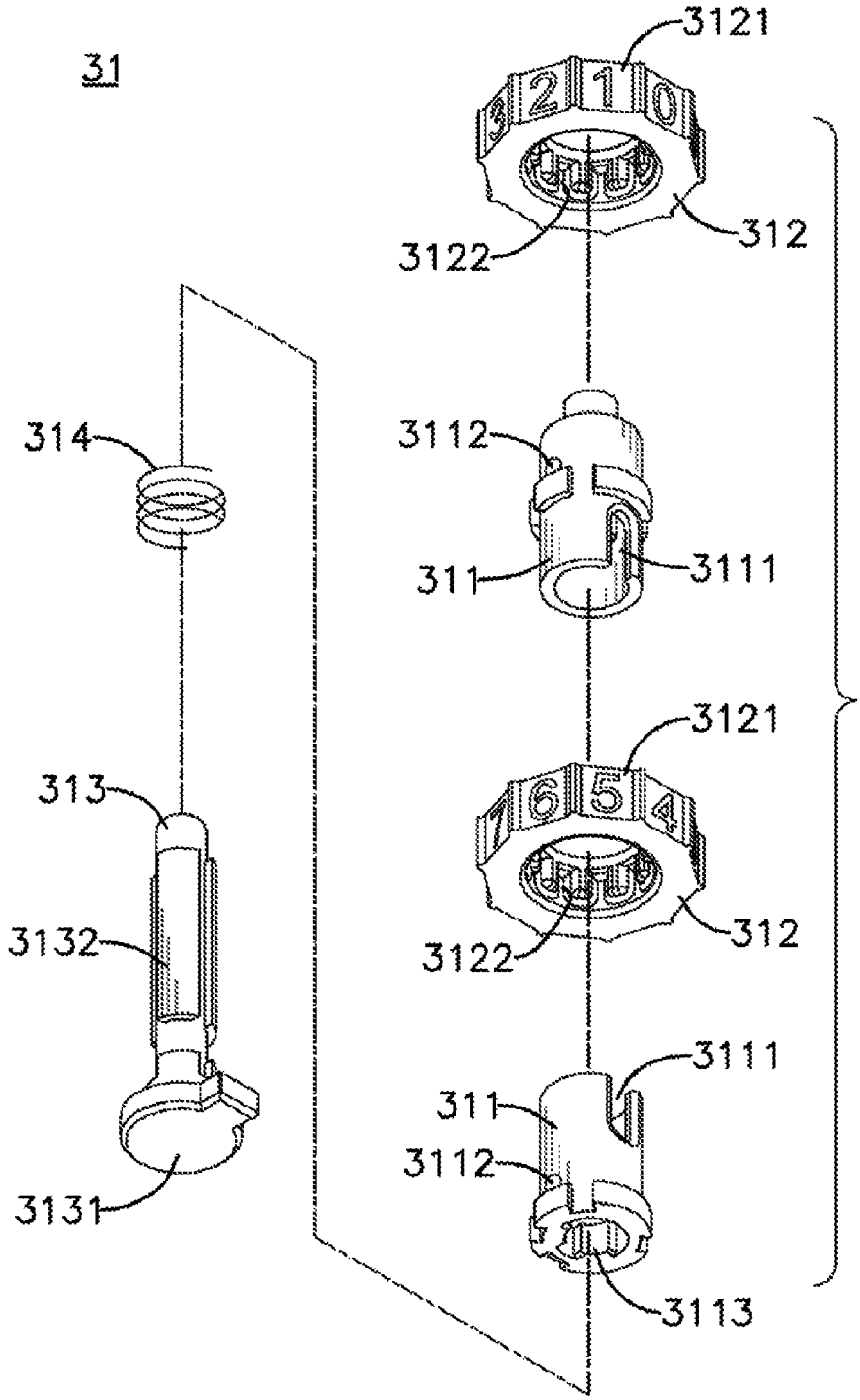
FIG. 4 is an exploded perspective view of a combination core of the cam lock in FIG. 1.

With reference to FIGS. 2 and 4, the main core assembly (30) is mounted in the inner shell (20) and comprises two combination cores (31), a locking actuator (32), a positioning panel (33) and a code-changing assembly (34).

The combination cores (31) are mounted in the front casing (21). Each combination core (31) has multiple sheaths (311), multiple wheels (312), a locking rod (313) and a combination core spring (314). The sheaths (311) are mounted separately in the front casing (21) and abut each other in sequence, and each sheath (311) has an identification notch (3111) formed in an outside wall thereof. Each wheel (312) is mounted around a corresponding sheath (311), protrudes through a corresponding dial hole (122) of the cover (12) and has multiple pattern sections (3121) formed on an outside wall thereof. Each pattern section (3121) has a certain pattern or number marked thereon to identify a code. The locking rod (313) is mounted through the sheaths (311) and has an enlarged head (3131) formed on a bottom end thereof. The combination core spring (314) is mounted around the locking rod (313) and is clamped between the enlarged head (3131) and one sheath (311). When the wheels (312) are rotated, the wheels (312) rotate the sheaths (3111). When the combination core (31) is locked, the locking rod (313) is restricted at axial movement. When the combination core (31) is unlocked, the locking rod (313) is free to move axially.

The person skilled in the art knows different kinds of corresponding structures for the sheaths (311), the wheels (312) and the locking rod (313) to cooperation with each other. In preferred embodiment as shown in FIGS. 3 and 4, each sheath (311) has a keyed protrusion (3112) formed on the outside wall thereof. Each wheel (312) has multiple keyed recesses (3122) formed separately in an inside wall thereof. The keyed protrusion (3112) of each sheath (311) engages one keyed recess (3122) of the corresponding wheel (312) to hold the sheaths (311) and the wheels (312) together. Each sheath (311) has multiple limiting protrusions (3113) formed separately on an inside wall thereof. The locking rod (313) has multiple locking ribs (3132) formed on an outside wall thereof. Each locking rib (3132) abuts the limiting protrusions (3113) of adjacent sheaths (311). When the combination core (31) is locked, the locking ribs (3132) are clamped axially between corresponding limiting protrusions (3132) to keep the locking rod (313) from moving axially. When the wheels (312) are rotated at a certain unlock code, the sheaths (311) are rotated correspondingly so that the locking ribs (3132) respectively align with intervals between the limiting protrusions (3113). Therefore, the locking rod (313) is allowed to move axially to unlock the combination core (31).

Figure 5:
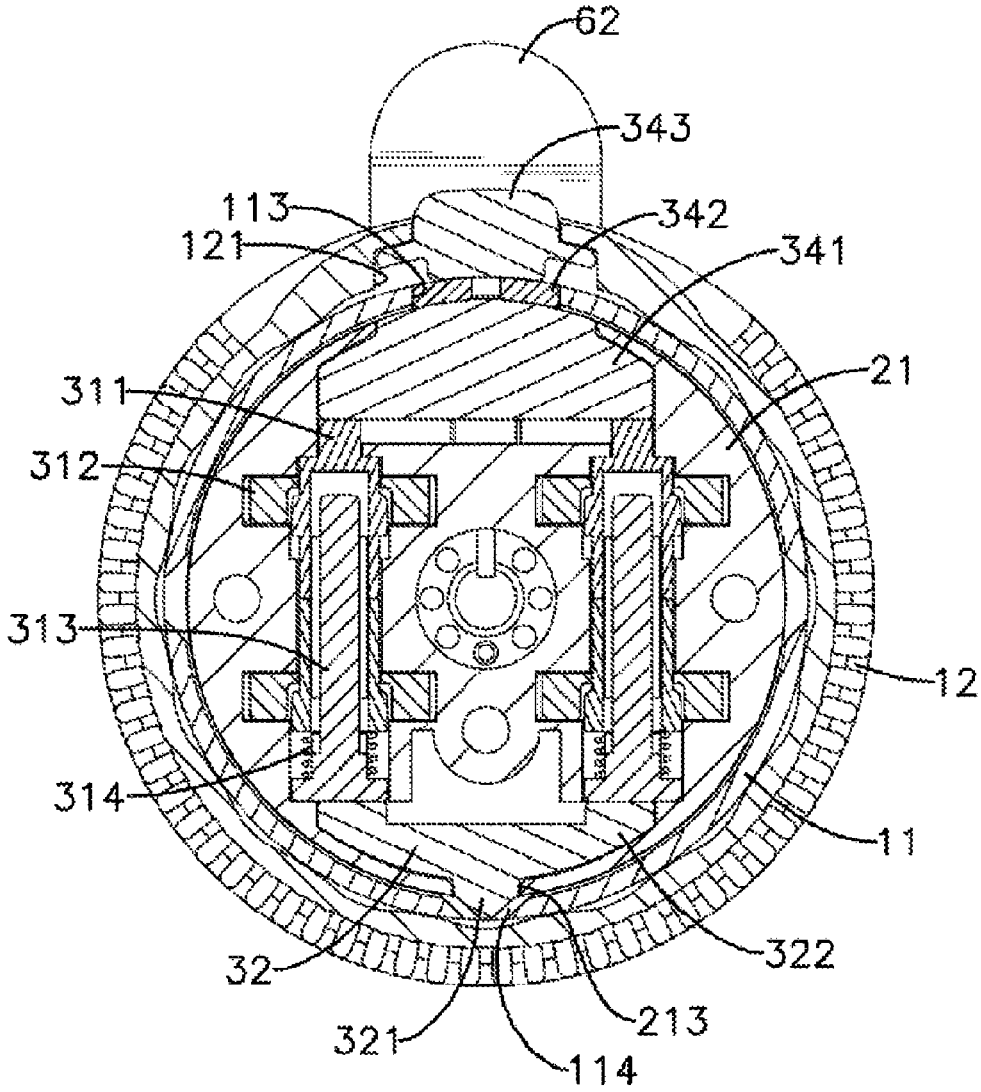
FIG. 5 is a front view in partial section of the cam lock in FIG. 1.
Figure 12:
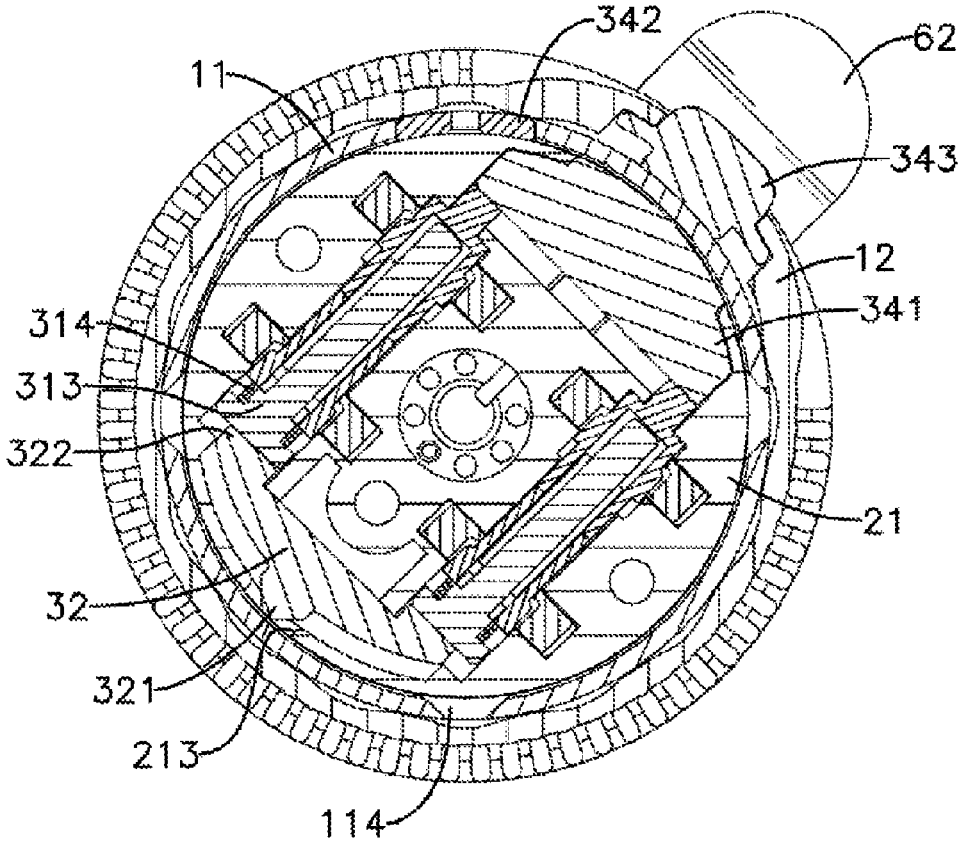
FIG. 12 is another operational front view in partial section of the cam lock in FIG. 1.

With reference to FIG. 5, the locking actuator (32) is mounted in the front casing (21) and corresponds to the connecting hole (213) of the front casing (21) and the mounting hole (114) of the rear casing (11). The locking actuator (32) has a locking protrusion (321) and two fingers (322). The locking protrusion (321) has two inclined sides, is formed on one side of the locking actuator (32), is mounted through the connecting hole (213) of the front casing (21) and is selectively mounted through the mounting hole (114) of the rear casing (11). The fingers (322) are formed separately on the other side of the locking actuator (32) and respectively abut the enlarged heads (3131) of the locking rods (313). When the combination cores (31) are locked, the locking protrusion (321) is mounted through the connecting hole (213) of the front casing (21) and the mounting hole (114) of the rear casing (11) since the locking rods (313) are kept from moving axially. When the combination cores (31) are unlocked as shown in FIG. 12, the locking rods (313) are allowed to move axially. When the cover (12) is rotated to rotate the front casing (21), the locking protrusion (321) abuts the mounting hole (114) of the rear casing (11). The inclined sides of the locking protrusion (321) move along the inclined sides of the mounting hole (114) so that the locking actuator (32) is retracted into the front casing (21). Thus, the cover (12) and the front casing (21) are free to rotate relative to the rear casing (11). When the front casing (21) is rotated back to the original position, the combination core springs (314) pushes the locking rods (313) back to force the locking protrusion (321) of the locking actuator (32) to protrude back into the mounting hole (114) of the rear casing (11). Therefore, the front and rear casings (21, 11) are held together again.

Figure 6:
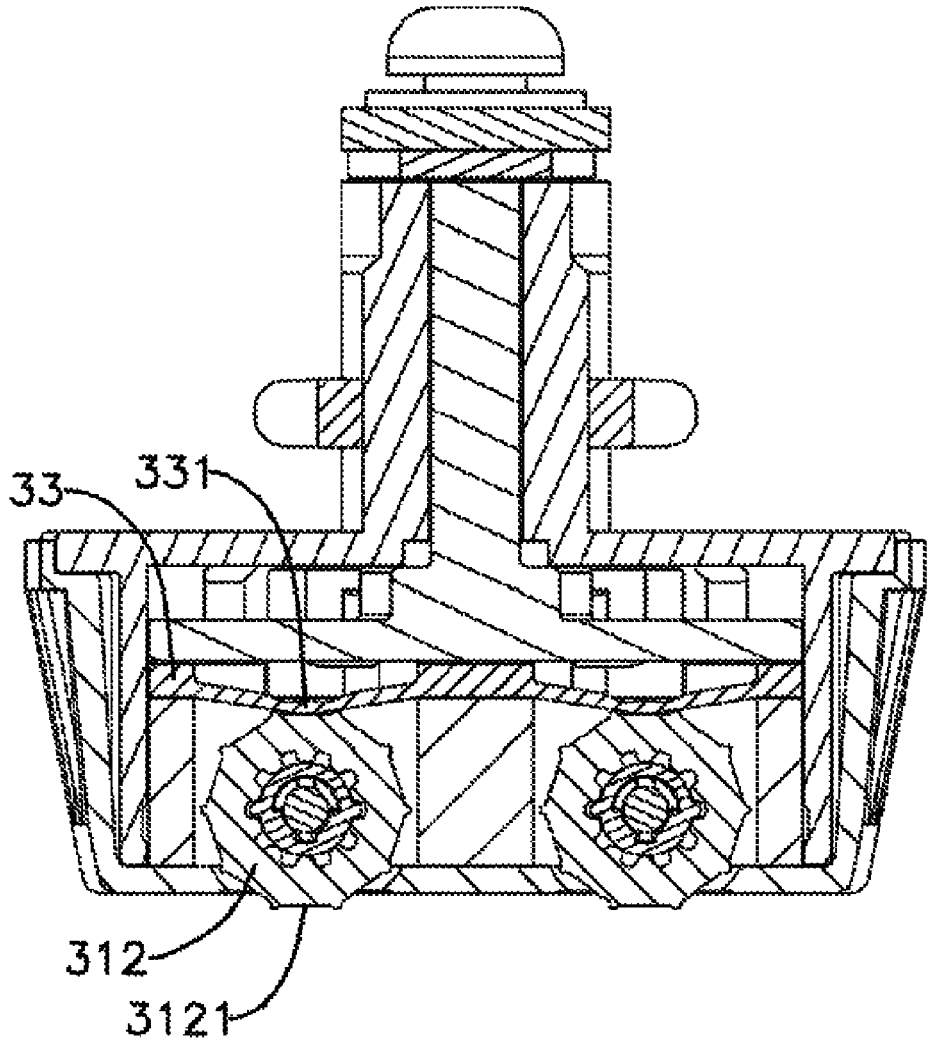
FIG. 6 is a cross-sectional top view of the cam lock in FIG. 1.

With reference to FIGS. 2 and 6, the positioning panel (33) is mounted in the front casing (21) and corresponds to the wheels (312), may be clamped between the front casing (21) and the rear panel (22) and has multiple resilient ribs (331) formed thereon. Each resilient rib (331) abuts a corresponding wheel (312) to position the corresponding wheel (312) at predetermined positions automatically.

Figure 7:
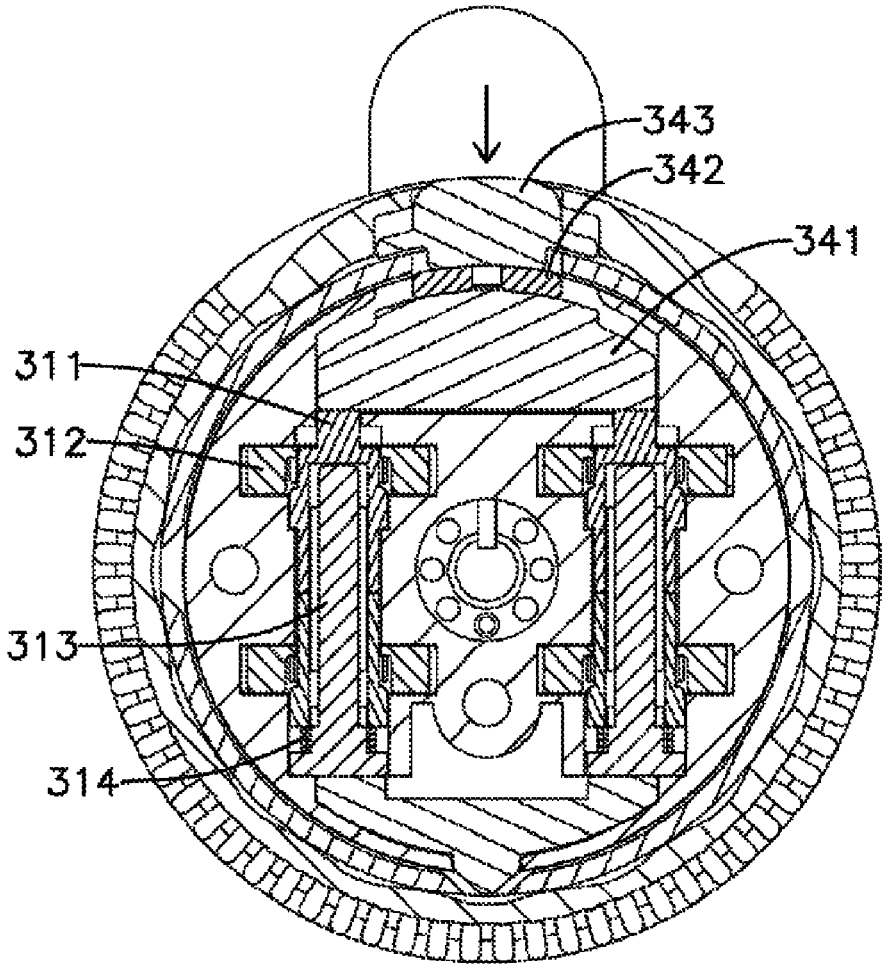
FIG. 7 is an operational front view in partial section of the cam lock in FIG. 1.

With reference to FIGS. 5 and 7, the code-changing assembly (34) is mounted in the inner and outer shells (20, 10) and comprises a driven slide (341), an intermediary slide (342) and a driving slide (343). The driven slide (341) is mounted in the front casing (21), corresponds to the yoke notch (113) of the rear casing (11) and presses against the corresponding sheaths (311) of the combination cores (31). The intermediary slide (342) is mounted in the yoke notch (113) of the rear casing (11), abuts the driven slide (341) and has a thickness the same with a thickness of the rear casing (11). The driving slide (343) is mounted in the through hole (121) of the cover (12) and abuts the intermediary slide (342).

With reference to FIGS. 4, 5 and 7, the code of the main core assembly (30) is allowed to change by the code-changing assembly (34) when the combination cores (30) are unlocked. The driving slide (343) is pressed to push the intermediary slide (342) and the driven slide (341) so that sheaths (311) are moved axially relative to the locking rods (313). Then the sheaths (311) disengage with the wheels (312) so that the wheels (312) are allowed to rotate without rotating the sheaths (311). The wheels (312) are rotated to set new codes. The user keeps pressing the driving slide (343) until the new codes are set. When the driving slide (343) is released, the combination core springs (314) push the sheaths (311) to move axially to engage with the wheels (312) again.

With reference to FIG. 2, the secondary core assembly (40) is mounted through the outer and inner shells (10, 20) and comprises a core rod (41) and a lock core (42). The core rod (41) is mounted through the first keyhole (123) of the cover (12) and the second keyhole (211) of the front casing (21). The lock core (42) is connected to the core rod (41) to selectively restrict the rotation of the core rod (41). When a certain key is inserted to unlock the lock core (42), the core rod (41) is rotatable via rotating the key. The lock core (42) may be any kind of core that is locked and unlocked via a key. In a preferred embodiment, the lock core (42) comprises multiple front pins (421), multiple rear pins (422) and multiple lock core springs (423). The core rod (41) has a rod body (411) non-circular in cross section and a flange (412). The flange (412) is formed around the rod body (411) and has multiple bores (4121). The bores (4121) formed separately through the flange (412), are arranged annularly and respectively align with the pin recesses (212) of the front casing (21). The front pins (421) are mounted respectively in the bores (4121) of the core rod (41). The rear pins (422) and the lock core springs (423) are mounted respectively in the pin recesses (212) of the front casing (21). Each rear pin (422) abuts a corresponding front pin (421). When the lock core (42) is locked, the rear pins (422) are pushed by the lock core springs (423) to protrude into the bores (4121) of the core rod (41) so that the core rod (41) is kept from rotating relative to the front casing (21). When a certain key is inserted to unlock the lock core (42), the front pins (421) are pressed to push the rear pins (422) moving backward. The contacting surfaces between the front pins (421) and the rear pins (422) are flush with the surface of the flange (412). Therefore, the core rod (41) is allowed to rotate relative to the front casing (21).

Figure 8:
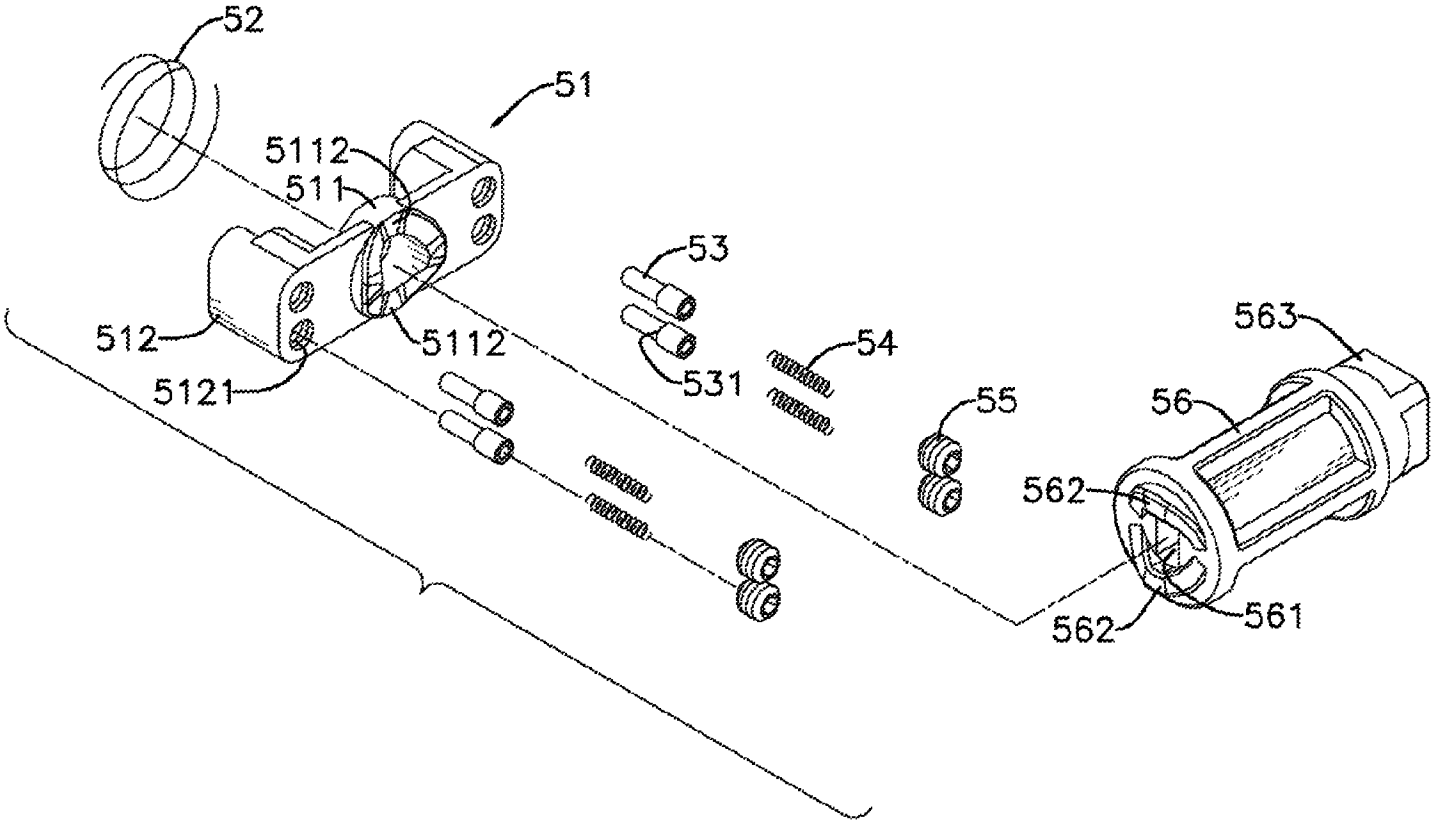
FIG. 8 is an exploded perspective view of an identification assembly of the cam lock in FIG. 1.

With reference to FIGS. 2 and 8, the identification assembly (50) is mounted in the inner shell (20) and comprises a seat (51), a first identification spring (52), multiple detecting pins (53), multiple second identification springs (54), multiple plugs (55) and an identification sleeve (56).

The seat (51) is mounted through the elongated hole (221) of the rear panel (22) and has a central body (511) and two extensions (512). The central body (511) has a central hole (5111) and multiple positioning detents (5112). The central hole (5111) is formed through the central body (511) and aligns with the second keyhole (211) of the front casing (21). The positioning detents (5112) are formed in a rear surface of the central body (511), and each positioning detent (5112) has two inclined ends. The extensions (512) are formed on two ends of the central body (511), are mounted through the positioning panel (33), protrude into the front casing (21) and respectively correspond to the sheaths (311) of the combination cores (31). Each extension (512) has multiple identification recesses (5121) formed therein. When the wheels (312) of the combination cores (31) are rotated to unlock the combination cores (31), each identification recess (5121) aligns with the identification notch (3111) of a corresponding sheath (311). The first identification spring (52) is mounted around the central body (511) and presses against the front casing (21). Each detecting pin (53) and each second identification spring (54) are mounted in a corresponding identification recess (5121). Each plug (55) is sealed a rear end of a corresponding identification recess (5121) to keep the detecting pins (53) and the second identification spring (54) from slipping out. Each detecting pin (53) has a shoulder (531) formed annularly thereon. The shoulder (531) of each detecting pin (53) selectively abuts a front wall of a corresponding identification recess (5121) to keep the detecting pin (53) from slipping out. The identification sleeve (56) is connected to the rear surface of the central body (511) of the seat (51), is mounted through the connecting sleeve (222) of the rear panel (22) and protrudes out of the guiding sleeve (111) of the rear casing (11). The identification sleeve (56) is connected securely to the core rod (41) of the secondary core assembly (40) so that the core rod (41) and the identification sleeve (56) are rotated together. The identification sleeve (56) may have a keyed recess (561) formed in a front end thereof. The rod body (411) of the core rod (41) may engage with the keyed recess (561). The identification sleeve (56) has multiple positioning protrusions (562) formed on the front end thereof. Each positioning protrusion (562) has two inclined ends and selectively engage engages with the positioning detents (5112) of the central part (511) of the seat (51). The identification sleeve (56) has a keyed protrusion (563) formed on a rear end thereof and having inner threads.

With the identification assembly (50), the user finds the codes as following operations.

With reference to FIGS. 8 and 9, the seat (51) is pressed by the first identification spring (52) to leave the front casing (21). The detecting pins (53) protrude into the front casing (21) without contacting with the sheaths (311) of the combination cores (31). The positioning detents (5112) of the seat (51) engage with the positioning protrusions (562) of the identification sleeve (56).

Figure 10:
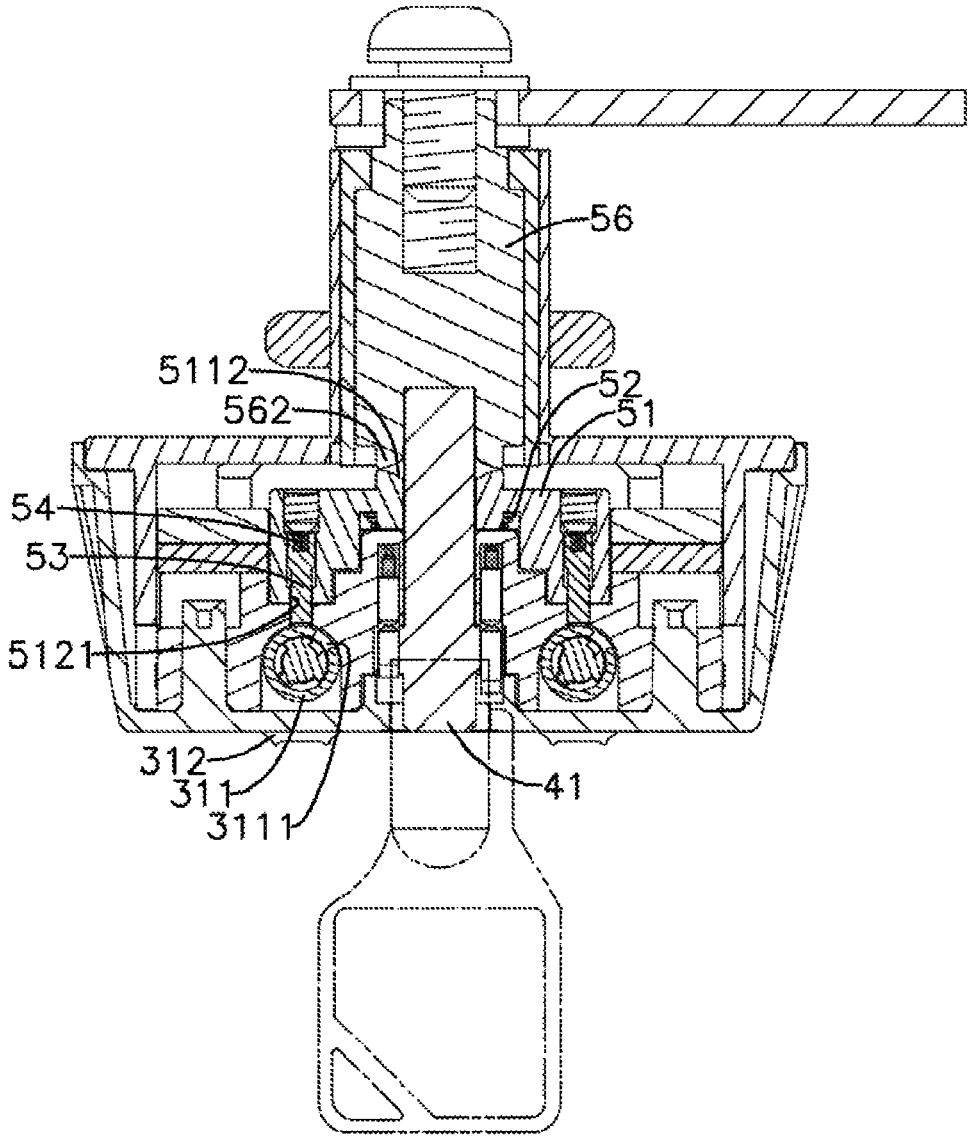
FIG. 10 is another operational cross-sectional top view of the cam lock in FIG. 1.

With further reference to FIG. 10, when the combination cores (31) are locked and the user forgets the code and need to find the code, the user inserts the certain key to unlock the lock core (42) and to rotate the core rod (41). When the core rod (41) rotates the identification sleeve (56), the positioning protrusions (562) disengage with the positioning detents (5112) of the seat (51) to push the seat (51) moving forward. Since the combination cores (31) are locked, the identification notches (3111) of the sheaths (311) misalign with the identification recesses (5121) of the seat (51). Therefore, the detecting pins (53) abut the outside wall of the sheaths (311) via the press of the second identification springs (54).

Figure 11:
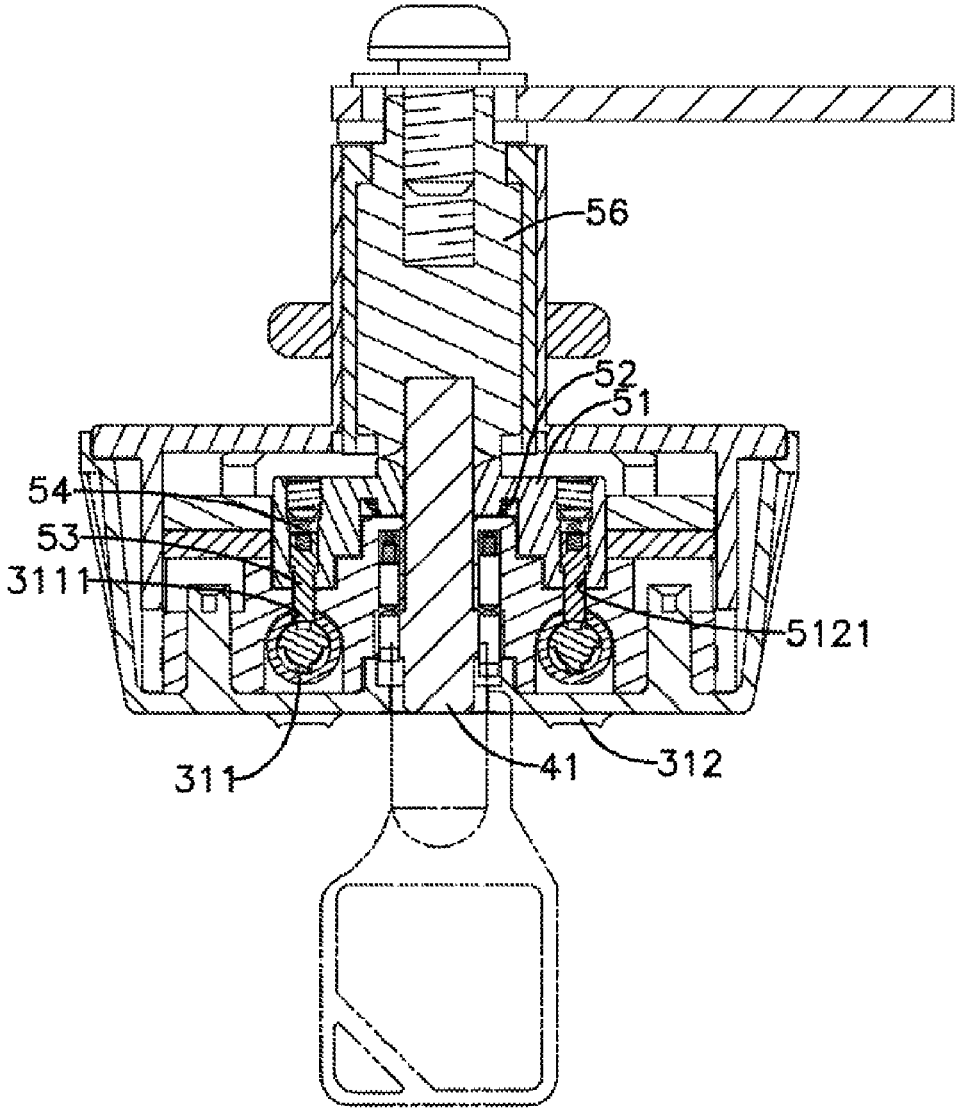
FIG. 11 is still another cross-sectional top view of the cam lock in FIG. 1.

With further reference to FIG. 11, the wheels (312) are rotated to rotate the sheaths (311). When the correct code is found, the identification notch (3111) of each sheath (311) aligns with the identification recess (5121) of the corresponding seat (51). Then the detecting pin (53) is pushed to engage with the identification notch (3111) of the sheath (311) so that the sheath (311) and the corresponding wheel (312) are kept from rotating to tell the user the correct code is found. When all the codes shown by the wheels (312) are found, the user returns and pulls out the certain key to rotate the identification sleeve (56) back. The positioning detents (5112) of the seat (51) again engage with the positioning protrusions (562) of the identification sleeve (56). Then the seat (51) is pushed backward by the first identification spring (52). When the seat (51) moves backward, the detecting pins (53) are brought backward via the abutting between the shoulders (531) and the seat (51). Therefore, the combination cores (31) are able to operate normally.

With reference to FIGS. 2 and 3, the tongue assembly (60) is connected to the rear surface of the rear casing (11) and comprises a limiting washer (61), a tongue (62) and a fastener (63). The limiting washer (61) is mounted securely around the keyed protrusion (563) of the identification sleeve (56) and has a limiting flange (611) formed on a periphery thereon. The limiting flange (611) selectively abuts the stop (112) of the rear casing (11) to limit the rotating angle of the identification sleeve (56). The tongue (62) is mounted securely around the keyed protrusion (563) of the identification sleeve (56). The fastener (63) is mounted securely into the identification sleeve (56) to hold the limiting washer (61) and the tongue (62). The fastener (63) may be a screw.

The cam lock as described is mounted on the door of the cabinet. The tongue (62) abuts the inside wall of the cabinet to lock the door.

Generally, the cam lock is locked and unlocked by the main core assembly (30). With reference to FIGS. 2 and 12, when the combination cores (31) are unlocked, the locking rods (313) are free to move axially and the locking actuator (32) is allowed to move upward. Then the cover (12) is rotated to rotate the front casing (21) and the components mounted in the front casing (21). Since the lock core (42) is locked, the core rod (41) is rotated simultaneously. Therefore, the identification sleeve (56) and the tongue (62) are rotated by the core rod (41) to move the tongue (62) leaving the inside wall of the cabinet so that the door is openable.

Figure 13:
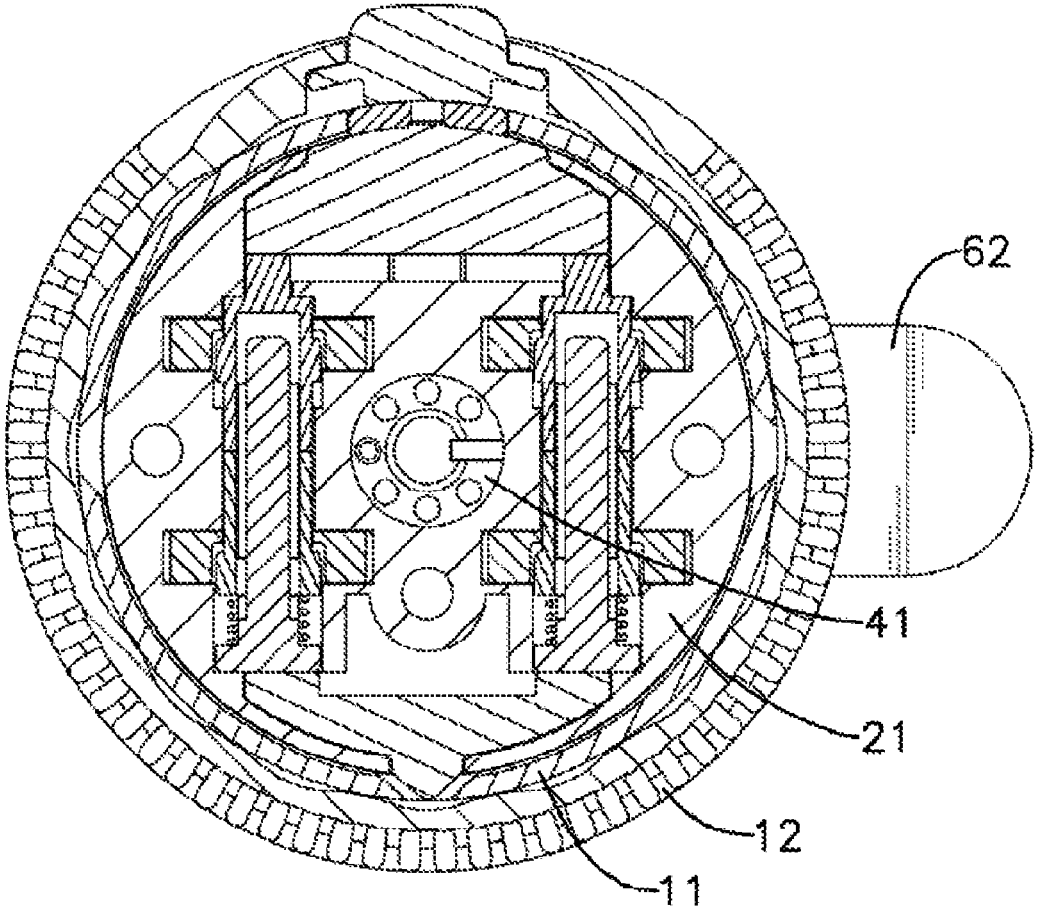
FIG. 13 is still another operational front view in partial section of the cam lock in FIG. 1.

When the codes to unlock the combination cores (31) are forgotten, the user may need a certain key to unlock the cam lock by the secondary core assembly (40). With reference to FIGS. 2, 10 and 13, the certain key is inserted to unlock the lock core (42). The core rod (41) is rotated to directly rotate the identification sleeve (56) and the tongue (62) to move the tongue (62) leaving the inside wall of the cabinet so that the door is openable.

The cam lock as described has following advantages. With the secondary core assembly (40), the cam lock is still workable when the codes of the main core assembly (30) are forgotten. Moreover, with the identification assembly (50), the forgotten codes can be found by inserting the certain key. Therefore, the cam lock as described is convenient for use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cam lock for a cabinet comprising:

an outer shell comprising a hollow rear casing having a front opening; and a cover mounted rotatably around the rear casing and having a rear opening communicating with the front opening of the rear casing;

an inner shell mounted in the outer shell and is attached securely to the cover of the outer shell;

a main core assembly mounted in the inner shell and comprising two combination cores mounted in the inner shell and has multiple identification notches;

a locking actuator mounted in the inner shell, protruding into the rear casing of the outer shell and abutting the combination cores, wherein when the combination cores are unlocked, the locking actuator is free to move into the inner shell to allow the cover and the inner shell rotating relative to the rear casing; and a code-changing assembly mounted in the inner and outer shells and abutting the combination cores;

a secondary core assembly mounted through the outer and inner shells and comprising a core rod mounted through the cover and protruding into the inner shell; and a lock core connected to the core rod to selectively keep the core rod from rotating, wherein the core rod is rotatable relative to the inner and outer shells when the lock core is unlocked, and the core rod is bound with the inner shell when the lock core is locked;

an identification assembly mounted in the inner shell and comprising a seat mounted through the inner shell and having a central body having a central hole formed through the central body; and multiple positioning detents formed in a rear surface of the central body, and each positioning detent having two inclined ends; and two extensions formed on two ends of the central body and respectively corresponding to the combination cores, each extension having multiple identification recesses formed therein, wherein when the combination cores are unlocked, each identification recess aligns with a corresponding identification notch and having a rear end;

a first identification spring mounted around the central body and presses against the inner shell;

multiple detecting pins mounted respectively in the identification recesses, each detecting pin has an annular shoulder selectively abutting a front wall of a corresponding identification recess;

multiple second identification springs mounted respectively in the identification recesses;

multiple plugs respectively sealing the rear ends of the identification recesses; and an identification sleeve connected to the rear surface of the central body of the seat, mounted through the rear casing, connected securely to the core rod and having multiple positioning protrusions formed on the front end thereof, and each positioning protrusion having two inclined ends and selectively engaging with the positioning detents of a central part of the seat; and a tongue assembly connected to the rear casing and comprising a tongue mounted securely around the identification sleeve.

2. The cam lock as claimed in claim 1, wherein the cover has multiple dial holes formed through a front surface of the cover;

each combination core comprising multiple sheaths mounted in the inner shell;

multiple wheels mounted respectively around sheaths, mounted respectively through the dial holes and having multiple pattern sections formed on an outside wall thereof;

a locking rod mounted through the sheath of the combination core and having an enlarged head formed on a bottom end thereof; and a combination core spring mounted around the locking rod and clamped between the enlarged head and one sheath; and each identification notch of each combination core is formed in an outside wall of a corresponding sheath.

3. The cam lock as claimed in claim 2, wherein each sheath has multiple limiting protrusions formed separately on an inside wall thereof; and the locking rod has multiple locking ribs formed on an outside wall thereof and each locking rib abuts a corresponding limiting protrusion of adjacent sheaths.

4. The cam lock as claimed in claim 3, wherein each wheel has multiple keyed recesses formed separately in an inside wall thereof;

each sheath has a keyed protrusion formed on the outside wall thereof and selectively engaging one keyed recess of the corresponding wheel.

5. The cam lock as claimed in claim 4, wherein the main core assembly has a positioning panel mounted in the inner shell, corresponding to the wheels and having multiple resilient ribs formed thereon, and each resilient rib abuts a corresponding wheel.

6. The cam lock as claimed in claim 1, wherein the inner shell has a front casing attached securely to the cover; and a rear panel attached securely to a rear surface of the front casing and having an elongated hole; and the seat of the identification assembly is mounted through the elongated hole of the rear panel.

7. The cam lock as claimed in claim 2, wherein the inner shell has a front casing attached securely to the cover; and a rear panel attached securely to a rear surface of the front casing and having an elongated hole; and the seat of the identification assembly is mounted through the elongated hole of the rear panel.

8. The cam lock as claimed in claim 7, wherein the rear casing has a mounting hole formed through a sidewall of the rear casing and having two inclined ends;

the front casing has a connecting hole formed through a sidewall of the front casing and selectively aligning with the mounting hole of the rear casing; and the locking actuator of the main core assembly is mounted in the front casing and having a locking protrusion formed on one side of the locking actuator, having two inclined sides, formed on one side of the locking actuator, mounted through the connecting hole of the front casing and selectively mounted through the mounting hole of the rear casing; and two fingers formed separately on the other side of the locking actuator and respectively abutting the enlarged heads of the locking rods.

9. The cam lock as claimed in claim 7, wherein the rear casing has a yoke notch formed through a sidewall of the rear casing;

the cover has a through hole formed through a sidewall of the cover and selectively aligning with the yoke notch of the rear casing; and the code-changing assembly comprising a driven slide mounted in the front casing, corresponding to the yoke notch of the rear casing and pressing against the corresponding sheaths of the combination cores;

an intermediary slide mounted in the yoke notch of the rear casing, abutting the driven slide and having a thickness the same with a thickness of the rear casing; and a driving slide mounted in the through hole of the cover and abutting the intermediary slide.

10. The cam lock as claimed in claim 6, wherein the cover has a first keyhole;

the front casing has a second keyhole aligning with the first keyhole; and multiple pin recesses formed in the front casing and arranged around the second keyhole;

the core rod of the secondary core assembly has a rod body; and a flange formed around the rod body and having multiple bores formed separately through the flange, arranged annularly and respectively aligning with the pin recesses of the front casing; and the lock core of the secondary core assembly comprising multiple front pins mounted respectively in the bores of the core rod;

multiple rear pins mounted respectively in the pin recesses of the front casing, each rear pin abutting a corresponding front pin; and multiple lock core springs mounted respectively in the pin recesses of the front casing.

11. The cam lock as claimed in claim 7, wherein the cover has a first keyhole;

the front casing has a second keyhole aligning with the first keyhole; and multiple pin recesses formed in the front casing and arranged around the second keyhole;

the core rod of the secondary core assembly has a rod body; and a flange formed around the rod body and having multiple bores formed separately through the flange, arranged annularly and respectively aligning with the pin recesses of the front casing; and the lock core of the secondary core assembly comprising multiple front pins mounted respectively in the bores of the core rod;

multiple rear pins mounted respectively in the pin recesses of the front casing, each rear pin abutting a corresponding front pin; and multiple lock core springs mounted respectively in the pin recesses of the front casing.

12. The cam lock as claimed in claim 10, wherein the rear casing has a guiding sleeve formed longitudinally on the rear surface of the rear casing; and a stop formed on a rear end of the guiding sleeve;

the rear panel has a connecting sleeve formed on a rear surface of the rear panel, communicating with the elongated hole, aligning with the second keyhole and mounted through and protruding out of the guiding sleeve;

the identification sleeve is mounted through the connecting sleeve of the rear panel and protrudes out of the guiding sleeve of the rear casing; and the tongue assembly comprises a limiting washer mounted securely around the identification sleeve and having a limiting flange formed on a periphery thereon and selectively abutting the stop of the rear casing.

* * * * *